US007670446B2

(12) United States Patent
Puszynski et al.

(10) Patent No.: US 7,670,446 B2
(45) Date of Patent: Mar. 2, 2010

(54) WET PROCESSING AND LOADING OF PERCUSSION PRIMERS BASED ON METASTABLE NANOENERGETIC COMPOSITES

(75) Inventors: Jan A. Puszynski, Rapid City, SD (US); Magdy M. Bichay, Springfield, VA (US); Jacek J. Swiatkiewicz, Rapid City, SD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 116 days.

(21) Appl. No.: 11/109,460

(22) Filed: Apr. 19, 2005

(65) Prior Publication Data

US 2006/0113014 A1 Jun. 1, 2006

Related U.S. Application Data

(63) Continuation-in-part of application No. 11/000,678, filed on Nov. 30, 2004, now abandoned.

(51) Int. Cl.

| | |
|---|---|
| ***C06B 33/00*** | (2006.01) |
| ***C06B 33/02*** | (2006.01) |
| ***C06B 27/00*** | (2006.01) |
| ***D03D 23/00*** | (2006.01) |
| ***D03D 43/00*** | (2006.01) |

(52) U.S. Cl. ..... 149/109.6; 149/37; 149/44; 149/87; 149/108.2; 149/108.6; 149/109.2

(58) Field of Classification Search ..... 149/37, 149/44, 87, 108.2, 108.6, 109.2, 109.6
See application file for complete search history.

(56) References Cited

U.S. PATENT DOCUMENTS

| | | | | |
|---|---|---|---|---|
| 2,915,519 | A * | 12/1959 | Stewart et al. | 536/38 |
| 3,781,177 | A * | 12/1973 | Kondis et al. | 149/6 |
| 3,879,164 | A * | 4/1975 | Haldopoulos et al. | 432/10 |
| 5,279,463 | A * | 1/1994 | Holl | 241/1 |
| 6,416,600 | B1 * | 7/2002 | Clarke et al. | 149/109.6 |
| 6,652,682 | B1 * | 11/2003 | Fawls et al. | 149/22 |
| 6,652,757 | B2 * | 11/2003 | Hodges et al. | 210/709 |
| 2005/0183805 | A1 * | 8/2005 | Pile et al. | 149/39 |
| 2006/0060273 | A1 * | 3/2006 | Smith | 149/92 |

* cited by examiner

*Primary Examiner*—Jerry Lorengo
*Assistant Examiner*—James E McDonough
(74) *Attorney, Agent, or Firm*—Fredric J. Zimmerman

(57) ABSTRACT

A method is disclosed for preparing metastable nanoenergetic composites (MNC) and for wet loading those MNCs into percussion primer cups. The method involves dispersing nanosize reactants in an inert liquid or, alternatively, making a nanosize reactant surface modification for improvement of reactant's chemical inertness towards water, followed by application of additives supporting a solid reactant particle dispersion in water or water solution prior to mixing. After mixing of the reactants, one maintains the presence of liquid water together within an energetic material in order to enhance safety during pre-loading of the primer mixture into the primer cups and during the final drying.

12 Claims, No Drawings

WET PROCESSING AND LOADING OF PERCUSSION PRIMERS BASED ON METASTABLE NANOENERGETIC COMPOSITES

CROSS-REFERENCE TO RELATED APPLICATION

This application is a continuation-in-part of application Ser. No. 11/000,678 filed on Nov. 30, 2004 now abandoned, and entitled "Environmentally Benign Energetic Materials Based on Aluminum and Bismuth Trioxide".

STATEMENT REGARDING FEDERALLY SPONSORED RESEARCH OR DEVELOPMENT

This invention was made with U.S. Government support under Grant Nos. DADD19-01-1-0503 and W911NF-05-1-0310 from the U.S. Army Research Office and under Contract No. N00174-05-M-0141 with the U.S. Naval Surface Warfare Center, Indian Head. The U.S. Government has certain rights in this invention.

FIELD OF THE INVENTION

This invention generally relates to the processing of energetic materials consisting of nanosize metal and oxidizer powders.

BACKGROUND OF THE INVENTION

During the past several years the Department of Defense (DOD) and the Department of Energy (DOE) have made a significant effort to find a replacement for currently used lead styphanate-based percussion primers due to their toxicity. Several metastable nanoenergetic composites (MNC, also known as metastable interstitial composites or superthermites), including Al—$MoO_3$, Al—$WO_3$, Al—CuO and Al—$Bi_2O_3$, were identified as the potential substitutes for currently used lead styphanate. These materials have shown excellent performance characteristics, such as impact sensitivity, high temperature output and low temperature ignition limit. However, it has been found that the MNC systems, despite of their excellent performance characteristics, are difficult to process safely. The main difficulty is handling of dry MNC powder mixtures due to their sensitivity to friction and electrostatic discharge (ESD).

It has been demonstrated at a laboratory scale that it is possible to mix nanosize (i.e., granules with dimensions on the order of $<10^{-6}$ m) aluminum and oxidizer powders in low-boiling temperature solvents using ultrasonic devices. After the mixing, the solvent is vaporized and MNC mixture is collected from the drying pan. The MNC powder is weighed and dry-loaded into percussion primer cups. Unfortunately, this process has several drawbacks which prevent its scale-up. These drawbacks include: i) the necessity of using organic solvents, ii) potentially inadequate dispersion and mixing, iii) drying and handling of sensitive MNC mixtures, iv) dry-loading of sensitive MNC mixtures, and v) adverse susceptibility of the MNC percussion primers to humid air and liquid water. Up to now, there has been no reported research work addressing the use of surface modifiers and additives to efficiently prevent reaction of aluminum nanopowders with water, to improve dispersion and mixing in liquid water and to reduce the ESD, friction and impact sensitivities during processing and loading of percussion primers. All these outlined processing characteristics are essential for scale-up of percussion primer production.

SUMMARY OF THE INVENTION

The invention herein encompasses organic solvent and/or water based processing of aluminum, molybdenum trioxide, tungsten trioxide, copper oxide, bismuth trioxide, and other particulate oxidants, and is a process involving the surface functionalization of aluminum nanopowder, dispersion in liquids, use of additives, mixing and percussion primer loading.

In a broad embodiment, the invention is a method of preparation of metastable nanoenergetic composite (MNC) based percussion primers, comprising following process: dispersing and mixing of nanometer grain size powder reactants (which may be referred to as reactant nanopowders or nanoreactants), which are not sensitive or made insensitive to moisture and water, are conducted in a water solution containing additives, wherein the additives aid the reactants' nanoparticle dispersion, and may also include addition of energetic additives (e.g. PETN [pentaerythritol tetranitrate] or GAP [glycidyl azide polymers]); and mixing of all components using ultrasonic or high shear rate mixers, which is continued until a homogeneous slurry is formed.

An object of this invention is to provide a method of preparation of metastable nanoenergetic composites (MNC) that may be used in percussion primers, ignition devices, propellants, explosives, pyrotechnic formulations, and similar products, for both military and commercial applications.

It is another object of the invention to provide a method of preparation of metastable nanoenergetic composite (MNC) based percussion primers that can be used as a substitute for lead-based energetic materials.

It is a further object of the invention to provide a method of preparation of metastable nanoenergetic composites (MNC) that are less susceptible to degradation and other performance problems due to reactivity to, and availability of, other reactants, such as water and oxygen.

It is yet another object of the invention to provide a method of preparation of organic and/or inorganic coatings on the surface of reactant nanopowders of the MNC, comprising of a chemically bonded layer of organic and/or inorganic coatings on the surface of the reactant nanopowder sensitive to moisture for the purpose of processing in liquid water, extending its shelf-life, and for supporting powder dispersion in liquid dispersants.

It is a further object of the invention to provide a method of preparation of metastable nanoenergetic composites (MNC), through dispersion and mixing of the MNC nanoreactants, which might be sensitive to water or moisture, in an inert organic solvent containing additives. In a preferred embodiment of this invention the additives aid the reactants' nanoparticle dispersion, and may include addition of energetic additives (e.g. PETN, GAP). The slurry consists of a homogeneous mixture of components and organic liquid in predetermined concentration of solids in a slurry or paste, which will become suitable for volume filling of the primer cups.

It is a further object of the invention to provide another method of preparation of metastable nanoenergetic composites (MNC), through dispersion and mixing of the MNC nanoreactants, which might be not sensitive or made insensitive to water or moisture, in water solution containing additives. In a preferred embodiment of this invention the additives are aiding reactant's nanoparticle dispersion, and may include addition of energetic additives (e.g. PETN, GAP). The slurry consists of a homogeneous mixture of components and water in predetermined concentration of solids in a slurry or paste, which will become suitable for volume filling of the primer cups.

It is a yet further object of the invention to provide another method of preparation of metastable nanoenergetic composites (MNC), through dispersion and mixing of the MNC nanoreactants, which are not sensitive or made insensitive to moisture and water, in water solution containing additives. In a preferred embodiment of this invention the additives are aiding reactant's nanoparticle dispersion and/or co-aggregation of solid reactants, and may include addition of energetic additives (e.g. PETN, GAP). The process further comprises the removal of water from mixed primer composition by drying, while maintaining presence of water within a solid powder, followed with pre-loading of the primer mixture into the percussion primer cups. The residual water is then removed from percussion primers in a convective or vacuum oven at ambient or elevated temperature. Process is concluded by pressing the MNC mixture inside the percussion primer cup into a form suitable for the insertion of an anvil. The anvil is subsequently inserted using broadly known methods.

It is a further object of the invention to provide another method of preparation of metastable nanoenergetic composites (MNC), through dispersion and mixing of the MNC nanoreactants, which are not sensitive or made insensitive to moisture and water, in an organic solvent miscible with water, containing additives. In a preferred embodiment of this invention the additives aid the reactants' nanoparticle dispersion, and may include addition of energetic additives (e.g. PETN, GAP). The slurry containing a homogeneous mixture of components is then mixed with at least equal volume of water. Suspension is allowed to flocculate and then is filtered to remove excess of water and co-solvent, and leave moist solid powder of the metastable nanoenergetic composite suitable for continuing with primer loading steps. The MNC solid powder can be re-suspended in water in order to achieve predetermined concentration of solids in a slurry or paste suitable for volume filling of the primer cups.

The present invention may be used in formulation processes for various applications including percussion primers, electric matches, fuses, propellants, explosives, pyrotechnic formulations, energetic materials in warheads and other military weapon systems, as well as an intermittent energy source. The versatility of the present invention is yet another advantage to its use as a replacement for currently used lead-based compositions.

DETAILED DESCRIPTION AND PREFERRED EMBODIMENTS

Metastable nanoenergetic composites (MNC) are multicomponent mixtures of solid reactants. When ignited, the fast reaction between reactants generates large quantity of heat (i.e., a strongly exothermic reaction). The MNCs are applied for creating conditions where resulting high temperature and pressure is desired. One of such application of metastable nanoenergetic composites is preparing of new lead-free percussion primers. These composites are made from very small particles of reactive materials, including nanosize aluminum and an oxidizer. Recent efforts have been primarily focused on molybdenum trioxide, copper oxide, bismuth trioxide, and tungsten trioxide as oxidants for nanosize aluminum. Such mixtures of aluminum and oxidants form energetic composites which are characterized by different heats of reaction, as shown in Table 1, and energy release dynamics.

TABLE 1

Adiabatic temperatures, heat of reactions per mass and per volume, and the amount of generated gas during the reaction for different energetic reacting systems.

| Reaction | Adiabatic temperature $T_{ad}$ [K] | Theoretical density of binary mixture $\rho$ [kg/m$^3$] | Heat of reaction [cal/g] | Heat of reaction [cal/cm$^3$] | Gas generation [g gas/g mixture] |
|---|---|---|---|---|---|
| 2Al + $Fe_2O_3$ | 3189 | 4.2 | 945.4 | 3,947 | 0.0784 |
| 2Al + 3CuO | 2749 | 5.0 | 974.1 | 4,976 | 0.3431 |
| 2Al + $MoO_3$ | 3820 | 4.5 | 1,124 | 4,279 | 0.2473 |
| 2Al + $WO_3$ | 3476 | 5.5 | 696.4 | 3,801 | 0.1463 |
| 2Al + $Bi_2O_3$ | 3325 | 5.7 | 506.0 | 3,638 | 0.8941 |

As can be seen in Table 1, aluminum-metal oxide MNC systems also differ in the amount of hot gases generated during the reaction.

The use of nanosize or larger particles of aluminum for such applications presents processing and handling problems. Essentially pure aluminum powder with particle sizes of approximately 20-500 nm is black and fluffy. If exposed to the air, it can immediately ignite and form aluminum oxide. To make such aluminum particles more processable in the presence of air, one can passivate the surface of the aluminum particles to reduce its reactivity with oxygen. The oxide passivation process consumes a portion of the aluminum itself, rendering that portion unavailable for its intended use as energetic material. The amount of aluminum metal that is available as fuel for reaction is defined as active aluminum. The oxide-passivated aluminum nanopowders still are sensitive to moisture in air and water, undergoing a slow hydroxylation on the surface, during which the amount of active aluminum can be significantly reduced. If the active aluminum content decreases below 50 wt %, the metastable nanoenergetic composite made out of such aluminum will not generate a sufficient amount of energy for the intended application.

Additionally, some of the reported metal oxides have a relatively strong affinity to moisture, which can result in accelerated aging of the MNC material and altering its performance. For example, molybdenum and tungsten trioxides react with water to form molybdic and tungstic acids. These acids may potentially reduce energetic outcome of the reaction with aluminum and generate less energy due to water retention.

The essential problem of chemical stability of the MNCs is focused on effective prevention of the hydroxylation reaction of the aluminum nanoparticles and hydrolysis and reduction reactions of the metal oxides.

In this invention a surface modification of aluminum nanopowder by chemical coating is applied in order to achieve two important effects: a) a significant reduction reaction rate of aluminum with water (in air and liquid water) and, b) improvement of nanoparticles dispersion in organic solvents and water. This particular application of the coating process constitutes an important part of the invention. In the method, the metal oxides in the fuel reaction used in combination with aluminum are selected from the group consisting of oxides of Mo, W, Bi, or Cu or alloys thereof, embodiments of which include, but not restricted to, $MoO_3$, $WO_3$, $Bi_2O_3$, and CuO.

Reactive mixtures of nanoenergetic composites consist of small particles of components intermixed to form large number of close contacts between reactant particles. The reactant nanopowders are synthesized separately and then must be mixed in a safe and consistent manner in order to obtain a metastable nanoenergetic composite. It has been demonstrated at a laboratory scale that it is possible to mix nanosize aluminum and oxidant powders in low-boiling temperature solvents using ultrasonic devices. After the mixing, the solvent is vaporized and the MNC mixture is collected from the drying pan. The collected powder is weighed in aliquots and dry-loaded into percussion primer cups. However, it has been found that dry MNC systems are difficult to process safely. The main difficulty is handling of dry MNC powder mixtures due to their sensitivity to friction and electrostatic discharge (ESD). Handling of an easy dispersing as dust energetic material may potentially lead to serious consequences during loading the percussion primer cups.

In order to reduce safety threats during introduction of the energetic material into the percussion primer cup a concept of use of residual water is a critical element of this invention. When dispersing liquid is evaporated off in a controlled manner, a portion of water (2-30 wt %) stays remnant in the solid powder. Another method of concentrating MNC suspensions for suitable primer loading is based on flocculation of mixed reactants followed by filtering or centrifuging. The MNC appears as a solid powder, and can be manipulated as such. In this form the sensitivity of the MNC to the impact is multifold reduced. However, this moist powder is in aggregated form of well intermixed reactant nanoparticles. After pre-loading of measured quantity of the MNC percussion primer into primer cup, the residual water is removed from the primer mixture by evaporation in vacuum or ambient pressure. The complete removal of water will permit full recovery of the MNC percussion primer sensitivity.

Mixing and processing of the metastable nanoenergetic composites has been typically carried out in organic solvents, which can raise environmental and safety concerns. Organic solvent handling demands additional precautions and engineering effort. Therefore, water as a benign and nonflammable liquid would be the best choice for the dispersing liquid. Residual water content in the MNC powder adds safety measures into the percussion primer processing, as described earlier. Aluminum nanopowders with surfaces coated by a protective organic and/or inorganic layer can effectively sustain contact with liquid water for several hours without decreasing the active aluminum content. This additional preparation of aluminum nanopowder, also described earlier, is an essential component of the invention. It allows conducting MNC powder processing in presence of liquid water. Additional, a beneficial effect is related to increase of a safety margin when handling moist MNC powder. Further improvements of the wet-loading technique are presented in this invention as new methods of preparation of a dense water-based suspension of the MNC reactants suitable for volume metering of the primer mix into percussion primer cups. After water removal from the MNC mixture the resulting percussion primer is not affected by the process.

The protective organic and/or inorganic coating applied to said surfaces of said reactant powder granules is formed of an aliphatic or cyclic organic acid or a fluorine derivative thereof, or hydrogen phosphate/di-hydrogen phosphate salts, or a silane. Preferred are the dicarboxylic acids or long-chain fatty acids or fluorine derivatives thereof or ascorbic acid. Both organic or inorganic coating is believed to chemically bond to the surfaces of the fuel and oxidant particles. Typical additions which may be present include organic dispersing agents (e.g. sodium dioctylsulfosuccinate, $C_{12}$-$C_{14}$-tertalkyl ethoxylated amines, polyethylene glycol trimethylnonyl ether or naphthalene sulfonic acid) and/or excess of the organic coating material.

The following examples illustrate preferred embodiments of the method of this invention.

Example 1

This example illustrates a preparation procedure for applying an organic hydrophobic coating to an oxide-passivated aluminum nanopowder. In this example the coating of oleic acid in a total amount of 5 wt % is applied onto aluminum nanopowder of a 42 nm average particle size and 75 wt % of active aluminum.

a. Weigh 950 mg of aluminum nanopowder and place into a mixing vessel. Add 9 g of ethanol and soak the powder with the liquid ethanol to form a slurry.
b. Weigh 50 mg of oleic acid and dissolve in 1 g of ethanol; then mix this solution with the aluminum nanopowder slurry in the mixing vessel.
c. Place the vessel with the suspension in an ultrasonic bath and mix for 30 minutes. The resulting suspension should appear as a uniform slurry.
d. Pour the slurry into a shallow conductive pan and allow ethanol to vaporize in an oven at 20-50° C.
e. After removal of the ethanol, use a conductive spatula to carefully break the material into a free flowing powder. The dry powder can be stored in a conductive container for further processing.

Example 2

This example illustrates a preparation procedure for a metastable nanoenergetic composite comprising a mixture of oleic acid coated aluminum and bismuth oxide nanopowders in water. The primer mixture has following composition:

| Ingredient | Weight percent |
|---|---|
| Oleic acid (5 wt %) coated aluminum nanopowder from Example 1 | 20 |
| Bismuth oxide ($Bi_2O_3$) | 80 |

a. Weigh separately 200 mg of coated aluminum nanopowder and 800 mg of bismuth oxide.
b. Place the aluminum nanopowder into the mixing vessel. Add 3 g of 0.5 wt % solution of polyethylene glycol trimethylnonyl ether in water, and soak the powder with the liquid.
c. Add the bismuth oxide nanopowder and soak the powder with the liquid to form a suspension.
d. Place the vessel with the suspension in an ultrasonic bath and mix for 30 minutes. The resulting suspension should appear as a uniform slurry.
e. Using a pipette, place about 110 μL volume of the slurry on into one or more small drying pans. Each pan with an approximate area of 1 $cm^2$ will contain sufficient primer mixture to fill one typical primer cup.
f. Excess water is removed by controlled evaporation from the thin layer of slurry. This process is stopped when the water content in the powder above 15 wt % but less than 30 wt %. Drying is stopped by placing the moist MNC powder in a 100% relative humidity environment chamber.
g. Use a conductive spatula to carefully remove the moist MNC powder from the pans into a standard fixture used for pre-loading. The pre-loaded cup is removed from the loading fixture and collected in batches prepared for residual water removal in a vacuum oven.

h. The cups are weighed using an analytical balance before inserting them into a vacuum oven. The oven is set at temperature about 40° C. and after closing, the air is pumped out. Typical pressure in the oven is kept at about 1 to 4 mm of Hg. The progress of water removal is checked periodically by re-weighing the cups. It is considered finished when two consecutive weight totals are the same within 0.2 mg for a 30 cup batch.

i. Dry MNC powder in the cups is then re-densified and shaped with an appropriate punch in the loading press under 300 lbs loading force.

j. The anvil insertion is completed next with application of the appropriate fixture and a stop mechanism at a predetermined level.

Example 3

This example illustrates a preparation procedure for a metastable nanoenergetic composite comprising of oleic acid coated aluminum and bismuth oxide nanopowders. The component powders are first dispersed in acetone and then mixed with water. After solvent removal, the primer mixture has the following composition:

| Ingredient | Weight percent |
|---|---|
| Oleic acid (5 wt %) coated aluminum nanopowder of Example 1 | 20 |
| Bismuth oxide ($Bi_2O_3$) nanopowder | 80 |

a. Weigh separately 200 mg of oleic acid coated aluminum nanopowder and 800 mg bismuth oxide. This will yield 1 g of the dried primer after solvent removal.

b. Place the aluminum nanopowder into the mixing vessel. Add 3 g of 0.5 wt % solution of polyethylene glycol trimethylnonyl ether in acetone and soak the powder with the liquid.

c. Add the bismuth oxide nanopowder and soak the powder with the liquid to form a suspension.

d. Place the vessel with the suspension in an ultrasonic bath and mix for 30 minutes. The resulting suspension should appear as uniform slurry.

e. Add 12 g of water to the slurry and mix in ultrasonic bath for 10 minutes, and then let it stand for 30 minutes to aggregate.

f. The aggregated MNC powder can be filtered using common techniques. The uniformly spread powder mixture, which is still moist, is cut together with supporting filter membrane into pieces containing the desired amount of primer mixture for one primer cup.

g. Use a conductive spatula to carefully remove the moist MNC powder from the filter membrane into a standard fixture used for pre-loading. The pre-loaded cup is removed from the loading fixture and collected in batches prepared for residual water removal in a vacuum oven.

h. The batch of cups is weighed using an analytical balance before inserting them into a vacuum oven. The oven is set at temperature about 40° C. and after closing, the air is pumped out. Typical pressure in the oven is kept at about 1 to 4 mm of Hg. The progress of solvent removal is checked periodically by re-weighing the cups. It is considered finished when two consecutive weight totals are the same within 0.2 mg for a 30 cup batch.

i. Dry MNC powder in the cups is then re-densified and shaped with an appropriate punch in the loading press under 300 lbs loading force.

j. The anvil insertion is completed next with application of an appropriate fixture and a stop mechanism at a predetermined level.

Example 4

This example illustrates a preparation procedure for a metastable nanoenergetic composite comprising oleic acid coated aluminum and bismuth oxide nanopowders. The component powders are first dispersed in acetone and then mixed with water. The excess of solvents is removed by filtration and solids are re-suspended in water to obtain a concentrated slurry suitable for a direct loading into primer cups. After solvent removal, the primer mixture has following composition:

| Ingredient | Weight percent |
|---|---|
| Oleic acid (5 wt %) coated aluminum nanopowder of Example 1 | 20 |
| Bismuth oxide ($Bi_2O_3$) nanopowder | 80 |

a. Weigh separately 200 mg of oleic acid coated aluminum nanopowder and 800 mg bismuth oxide. This will yield 1 g of the dried primer after solvent removal.

b. Place the aluminum nanopowder into the mixing vessel. Add 3 g of 0.5 wt % solution of polyethylene glycol trimethylnonyl ether in acetone and soak the powder with the liquid.

c. Add the bismuth oxide nanopowder and soak the powder with the liquid to form a slurry.

d. Place the vessel with the suspension in an ultrasonic bath and mix for 30 minutes. The resulting suspension should appear as a uniform slurry.

e. Add 12 g of water to the slurry and mix in ultrasonic bath for 10 minutes, and then allow to stand for 30 minutes to aggregate.

f. The aggregated MNC powder can be filtered using common techniques. The uniformly spread powder mixture, which is still moist, is transferred from a filter membrane into a container where is mixed with water in order to obtain a predetermined total volume, for example of 1.0 mL.

g. The primer cups are filled up with the concentrated slurry and collected in batches prepared for residual water removal in a vacuum oven.

h. The batch of cups is weighed using an analytical balance before inserting them into the vacuum oven. The oven is set at temperature about 40° C. and after closing, the air is pumped out. Typical pressure in the oven is kept at about 1 to 4 mm of Hg. The progress of solvent removal is checked periodically by re-weighing the cups. It is considered finished when two consecutive weight totals are the same within 0.2 mg for a 30 cup batch.

i. Dry MNC powder in the cups is then re-densified and shaped with an appropriate punch in the loading press under 300 lbs loading force.

j. The anvil insertion is completed next with application of an appropriate fixture and a stop mechanism at a predetermined level.

Example 5

This example illustrates a preparation procedure for a metastable nanoenergetic composite comprising oxide-coated aluminum and bismuth oxide nanopowders. The component powders are dispersed in 1-methyl-2-pyrolidinone (NMP, an inert organic solvent). The pre-determined volume of solvent is used to obtain a concentrated slurry suitable for a direct loading into the primer cups. After solvent removal, the primer mixture has following composition:

| Ingredient | Weight percent |
|---|---|
| Oxide-coated aluminum nanopowder | 15 |
| Bismuth oxide ($Bi_2O_3$) nanopowder | 85 |

a. Weigh separately 150 mg of aluminum nanopowder and 850 mg of bismuth oxide. This will yield 1 g of the dried primer after solvent removal.
b. Place the aluminum nanopowder into a mixing vessel. Add 0.500 mL of NMP solvent and soak the powder with the liquid.
c. Add the bismuth oxide nanopowder and then add 0.350 mL of NMP, and soak the powder with the liquid to form a suspension.
d. Mix the components with a spatula and then place the vessel with the suspension in an ultrasonic bath and mix for 30 minutes. The resulting suspension should appear as a uniform dense slurry with a total volume about 1.0 mL.
e. The primer cups are filled up with the concentrated slurry and collected in batches prepared for residual solvent removal in a vacuum oven.
f. The batch of cups is weighed using an analytical balance before inserting them into the vacuum oven. The oven is set at temperature about 80° C. and after closing, the air is pumped out. Typical pressure in the oven is kept at about 1 to 4 mm of Hg. The progress of solvent removal is checked periodically by re-weighing the cups. It is considered finished when two consecutive weight totals are the same within 0.2 mg for a 30 cup batch.
g. Dry MNC powder in the cups is then re-densified and shaped with an appropriate punch in the loading press under 300 lbs loading force.
h. The anvil insertion is completed next with application of an appropriate fixture and a stop mechanism at a predetermined level.

Example 6

This example illustrates a preparation procedure for applying an organic coating to an oxide-passivated aluminum nanopowder. In this example the coating is succinic acid (butanedioic acid) in a total amount of 5 wt % and is applied onto an aluminum nanopowder with a 42 nm average particle size and 75 wt % of active aluminum.

a. Weigh 950 mg of aluminum nanopowder and place into a mixing vessel. Add 5 g of acetone and soak the powder with the liquid.
b. Weigh 50 mg of succinic acid and dissolve in 10 g of acetone, then mix this solution with the aluminum nanopowder slurry in the mixing vessel to form a suspension.
c. Place the vessel with the suspension in an ultrasonic bath and mix for 20 minutes. The resulting suspension should appear as a uniform slurry.
d. Pour the slurry into one or more shallow conductive pans and allow the acetone to vaporize in an oven at 20-50° C.
e. After removal of the acetone, use a conductive spatula to carefully break the material into a free flowing powder. The dry powder can be stored in a conductive container for further processing.

Example 7

This example illustrates a preparation procedure for a metastable nanoenergetic composite comprising succinic acid coated aluminum and bismuth oxide nanopowders. The component powders are dispersed in water. A pre-determined volume of water is used to obtain a concentrated slurry suitable for a direct loading into the primer cups. After water removal, the primer mixture has following composition:

| Ingredient | Weight percent |
|---|---|
| Succinic acid (5 wt %) coated aluminum nanopowder of Example 6 | 15 |
| Bismuth oxide ($Bi_2O_3$) nanopowder | 85 |

a. Weigh separately 150 mg of succinic acid coated aluminum nanopowder and 850 mg bismuth oxide. This will yield 1 g of the dried primer after solvent removal.
b. Place the aluminum nanopowder into a mixing vessel. Add 0.450 mL of water and soak the powder with the liquid.
c. Add the bismuth oxide nanopowder and then add 0.400 mL of water, and soak the powder with the liquid to form a suspension.
d. Mix the components with a spatula and then place the vessel with the suspension in an ultrasonic bath and mix for 30 minutes. The resulting suspension should appear as a uniform dense slurry with a total volume of about 1.0 mL.
e. The primer cups are filled up with the concentrated slurry and collected in batches prepared for residual water removal in a vacuum oven.
f. The batch of cups is weighed using an analytical balance before inserting them into the vacuum oven. The oven is set at temperature about 40° C. and after closing, the air is pumped out. Typical pressure in the oven is kept at about 1 to 4 mm of Hg. The progress of solvent removal is checked periodically by re-weighing the cups. It is considered finished when two consecutive weight totals are the same within 0.2 mg for a 30 cup batch.
g. Dry MNC powder in the cups is then re-densified and shaped with an appropriate punch in the loading press under 300 lbs loading force.
h. The anvil insertion is completed next with application of an appropriate fixture and a stop mechanism at a predetermined level.

It will be understood that the embodiments described above are specific examples of many possible variations of the same invention and are not intended in a limiting sense. The claimed invention can be practiced using other embodiments not specifically described above but clearly within the scope and spirit of the invention. Therefore, the descriptions above are to be considered exemplary only, and the scope of the invention is to be determined from the appended claims.

We claim:

1. A method for preparing a primary percussion primer containing a metastable nanoenergetic composite as a primary explosive ingredient where the metastable nanoenergetic composite is a sole explosive ingredient in the percussion primer, comprising:

mixing a hydrophilic protective reagent with an oxide-passivated aluminum nanopowder for coating a surface of said oxide-passivated aluminum nanopowder for forming a protected surface coated oxide-passivated aluminum nanopowder, wherein the hydrophilic protective reagent is selected from at least one of a group of organic and inorganic materials consisting of: dicarboxylic acids, hydrogen ammonium phosphate salts, fluorine derivatives, and dihydrogen ammonium phosphate salts;

mixing the protected oxide-passivated aluminum nanopowder and a metal oxide in a water solution to form a homogenous percussion primer slurry containing the metastable nanoenergetic composite;

filling a container with a predetermined volume of the percussion primer slurry; and removing water from the slurry.

2. The method according to claim 1, wherein said mixing the protected oxide-passivated aluminum nanopowder step is performed using one of an ultrasonic mixer and a high shear rate mixer.

3. The method according to claim 1, wherein the metal oxide is selected from the group consisting of oxides of Mo, W, Bi, and Cu.

4. The method according to claim 3, wherein the metal oxide is selected from the group consisting of: $MoQ_3$, $WO_3$, $Bi_2O_3$, and CuO.

5. The method according to claim 4, wherein the metal oxide is $Bi_2O_3$.

6. The method according to claim 1, wherein said mixing the protected oxide-passivated aluminum nanopowder step further comprises mixing with one of an organic dispersing agent, a binder and a filler.

7. The method according to claim 6, wherein the organic dispersing agent is selected from the group consisting of sodium dioctylsulfosuccinate, $C_{12}$-$C_{14}$ tertalkyl ethoxylated amines, polyethylene glycol trimethylnonyl ether and naphthalene sulfonic acid.

8. The method according to claim 1, wherein the container in said filling step further comprises a primer cup.

9. The method according to claim 1, wherein the slurry in said filling step further comprises a concentration of 20 to 80% by weight solids.

10. The method according to claim 9, wherein the slurry in said filling step further comprises a concentration of 40 to 60% by weight solids.

11. The method according to claim 1, wherein said removing step is performed in a vacuum or convective oven at temperature below 100° C. and at a pressure above 0.001 mm Hg.

12. The method according to claim 11, wherein said removing step is performed in a vacuum or convective oven at temperature of about 40° C. and at a pressure above 0.1 mm Hg.

* * * * *